US012584186B2

(12) United States Patent
Hata et al.

(10) Patent No.: US 12,584,186 B2
(45) Date of Patent: Mar. 24, 2026

(54) STEEL SHEET, MEMBER, METHOD OF PRODUCING STEEL SHEET, AND METHOD OF PRODUCING MEMBER

(71) Applicant: JFE STEEL CORPORATION, Tokyo (JP)

(72) Inventors: Katsuya Hata, Tokyo (JP); Shotaro Terashima, Tokyo (JP); Tatsuya Nakagaito, Tokyo (JP); Seisuke Tsuda, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 0 days.

(21) Appl. No.: 18/709,028

(22) PCT Filed: Oct. 14, 2022

(86) PCT No.: PCT/JP2022/038472

§ 371 (c)(1),
(2) Date: May 10, 2024

(87) PCT Pub. No.: WO2023/112461

PCT Pub. Date: Jun. 22, 2023

(65) Prior Publication Data

US 2025/0003021 A1 Jan. 2, 2025

(30) Foreign Application Priority Data

Dec. 13, 2021 (JP) ..... 2021-202069

(51) Int. Cl.

| | |
|---|---|
| ***C22C 38/02*** | (2006.01) |
| ***C21D 1/18*** | (2006.01) |
| ***C21D 6/00*** | (2006.01) |
| ***C21D 8/02*** | (2006.01) |
| ***C21D 8/021*** | (2026.01) |
| ***C21D 8/0221*** | (2026.01) |
| ***C21D 8/0247*** | (2026.01) |
| ***C21D 8/0278*** | (2026.01) |
| ***C21D 9/46*** | (2006.01) |
| ***C22C 38/00*** | (2006.01) |
| ***C22C 38/04*** | (2006.01) |
| ***C22C 38/06*** | (2006.01) |
| ***C22C 38/08*** | (2006.01) |

(Continued)

(52) U.S. Cl.

CPC ..... *C21D 9/46* (2013.01); *C21D 1/18* (2013.01); *C21D 6/002* (2013.01); *C21D 6/005* (2013.01); *C21D 6/008* (2013.01); *C21D 8/02* (2013.01); *C21D 8/021* (2013.01); *C21D 8/0226* (2013.01); *C21D 8/0236* (2013.01); *C21D 8/0263* (2013.01); *C21D 8/0278* (2013.01); *C22C 38/001* (2013.01); *C22C 38/002* (2013.01); *C22C 38/005* (2013.01); *C22C 38/008* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/22* (2013.01); *C22C 38/24* (2013.01); *C22C 38/28* (2013.01); *C22C 38/38* (2013.01); *C22C 38/60* (2013.01); *C23C 2/0224* (2022.08); *C23C 2/06* (2013.01); *C23C 2/40* (2013.01); *C21D 2211/001* (2013.01); *C21D 2211/002* (2013.01); *C21D 2211/005* (2013.01); *C21D 2211/008* (2013.01)

(58) Field of Classification Search

CPC ... C22C 38/001; C22C 38/002; C22C 38/005; C22C 38/008; C22C 38/02; C22C 38/04; C22C 38/06; C22C 38/08; C22C 38/12; C22C 38/14; C22C 38/16; C22C 38/24; C22C 38/28; C22C 38/38; C22C 38/60; C21D 2211/001; C21D 2211/002; C21D 2211/005; C21D 2211/008

USPC ..... 428/681

See application file for complete search history.

(56) References Cited

U.S. PATENT DOCUMENTS

| | | | |
|---|---|---|---|
| 2017/0096723 | A1 | 4/2017 | Kasuya et al. |
| 2019/0085426 | A1 | 3/2019 | Ikeda et al. |

(Continued)

FOREIGN PATENT DOCUMENTS

| | | | |
|---|---|---|---|
| JP | 2009249733 | A | 10/2009 |
| JP | 2011168816 | A | 9/2011 |

(Continued)

OTHER PUBLICATIONS

Dec. 16, 2024, the Extended European Search Report issued by the European Patent Office in the corresponding European Patent Application No. 22906996.8.

(Continued)

*Primary Examiner* — Katherine A Christy

(74) *Attorney, Agent, or Firm* — KENJA IP LAW PC

(57) ABSTRACT

A steel sheet having high strength, excellent ductility, high YR, and excellent bendability. The steel sheet includes a defined chemical composition, the steel microstructure includes: area ratio of ferrite: 5% or more and 65% or less, area ratio of martensite: 10% or more and 60% or less, area ratio of bainite: 10% or more and 60% or less, and area ratio of retained austenite: 5% or more. The relationship in the following Formula (1) is satisfied. Average solute C concentration of the retained austenite $[C]_\gamma$ is 0.5 mass % or more, and standard deviation of C concentration distribution in the retained austenite is 0.250 mass % or less.

$$[Mn]_\gamma/[Mn] \leq 1.20 \quad (1)$$

20 Claims, No Drawings

(51) Int. Cl.

| | |
|---|---|
| ***C22C 38/12*** | (2006.01) |
| ***C22C 38/14*** | (2006.01) |
| ***C22C 38/16*** | (2006.01) |
| ***C22C 38/22*** | (2006.01) |
| ***C22C 38/24*** | (2006.01) |
| ***C22C 38/28*** | (2006.01) |
| ***C22C 38/38*** | (2006.01) |
| ***C22C 38/60*** | (2006.01) |
| ***C23C 2/02*** | (2006.01) |
| ***C23C 2/06*** | (2006.01) |
| ***C23C 2/40*** | (2006.01) |

(56) References Cited

U.S. PATENT DOCUMENTS

| | | | |
|---|---|---|---|
| 2019/0218652 | A1 | 7/2019 | Haga et al. |
| 2021/0102278 | A1 | 4/2021 | Hasegawa et al. |
| 2021/0108282 | A1 | 4/2021 | Yoshiyasu et al. |
| 2022/0195552 | A1 | 6/2022 | Minami et al. |

FOREIGN PATENT DOCUMENTS

| | | | |
|---|---|---|---|
| JP | 2016180140 | A | 10/2016 |
| JP | 2017048412 | A | 3/2017 |
| JP | 2020100894 | A | 7/2020 |
| KR | 1020180120712 | A | 11/2018 |
| WO | 2015141097 | A1 | 9/2015 |
| WO | 2019159771 | A1 | 8/2019 |
| WO | 2019188643 | A1 | 10/2019 |
| WO | 2020184154 | A1 | 9/2020 |

OTHER PUBLICATIONS

Jan. 10, 2023, International Search Report issued in the International Patent Application No. PCT/JP2022/038472.

Nov. 17, 2025, Office Action issued by the Ministry of Intellectual Property in the corresponding Korean Patent Application No. 10-2024-7011890 with English language concise statement of relevance.

STEEL SHEET, MEMBER, METHOD OF PRODUCING STEEL SHEET, AND METHOD OF PRODUCING MEMBER

TECHNICAL FIELD

The present disclosure relates to a steel sheet, a member made from the steel sheet, and methods of producing same.

BACKGROUND

In recent years, from the viewpoint of global environment protection, attempts have been made in the automobile industry to reduce emissions of $CO_2$ and other exhaust gases. Specifically, by increasing the strength and thinning of steel sheets that are used as material for automobile members, automotive bodies are made lighter and fuel efficiency is improved. In this way, attempts are being made to reduce exhaust gas emissions.

As an example of a steel sheet used as a material of an automobile member, Patent Literature (PTL) 1 describes:

"A high strength steel sheet comprising a chemical composition containing, in mass %,
C: 0.05% to 0.20%,
Si: 0.3% to 1.50%,
Mn: 1.3% to 2.6%,
P: 0.001% to 0.03%,
S: 0.0001% to 0.01%,
Al: 0.0005% to 0.1%,
N: 0.0005% to 0.0040%, and
O: 0.0015% to 0.007%,
with the balance being iron and inevitable impurities, wherein the steel sheet microstructure consists mainly of ferrite and bainite microstructure, BH after baking treatment is 60 MPa or more, maximum tensile strength is 540 MPa or more, aging degradation is extremely low and bake hardenability is excellent."

PTL 2 describes:

"A galvannealed steel sheet comprising a chemical composition containing, in mass %,
C: 0.10% to 0.50%,
Mn: 1.0% to 3.0%,
Si: 0.005% to 2.5%, and
Al: 0.005% to 2.5%,
and limited to
P: 0.05% or less,
S: 0.02% or less, and
N: 0.006% or less,
wherein the sum of Si and Al satisfies Si+Al≥0.8%, the microstructure contains, by area ratio, 10% to 75% ferrite and 2% to 30% retained austenite, C content in the retained austenite is 0.8% to 1.0%, and ductility and corrosion resistance are excellent."

CITATION LIST

Patent Literature

PTL 1: JP 2009-249733 A
PTL 2: JP 2011-168816 A

SUMMARY

Technical Problem

Increasing the strength of a steel sheet typically reduces ductility. However, steel sheets used as materials for automobile members are required to have both high strength and excellent ductility, specifically, excellent ductility with high total elongation (hereinafter also referred to simply as E1) and uniform elongation (hereinafter also referred to simply as U.E1) in tensile tests.

Further, steel sheets used for automobile members, in particular automobile frame structural members and the like, are required to have high member strength when press-formed. In order to improve the strength of automobile members, increasing the yield ratio (hereinafter also referred to simply as YR), which is the yield stress of a steel sheet (hereinafter also referred to simply as YS) divided by TS, is effective, for example.

Further, steel sheets used for automobile frame structural members and the like are formed into complex shapes, requiring excellent formability, and in particular, excellent bendability.

However, the steel sheets described in PTL 1 and 2 do not satisfy all of the required properties described above. Further, the technology according to PTL 2 requires a long hold time after annealing to stabilize retained austenite. As a result, annealing facilities become larger, and there is a concern that facility costs will increase.

The present disclosure was developed in view of the above requirements, and it would be helpful to provide a steel sheet having high strength, excellent ductility, high YR, and excellent bendability, together with an advantageous method of producing the steel sheet.

Further, it would be helpful to provide a member using the steel sheet as a material and a method of producing the member.

Here, high strength means that tensile strength (hereinafter also referred to as TS) is 780 MPa or more as measured by a tensile test in accordance with Japanese Industrial Standard JIS Z 2241.

Excellent ductility means that total elongation (E1) and uniform elongation (U.E1) measured by a tensile test in accordance with JIS Z 2241 respectively satisfy the following expressions.

$$19\% \leq E1$$

$$10\% \leq U.E1$$

High YR means that YR calculated from TS and YS measured by a tensile test in accordance with JIS Z 2241 satisfies the following expression.

$$0.48 \leq YR$$

Here, YR is calculated by the following expression.

$$YR = YS/TS$$

Excellent bendability means that R (limit bending radius)/t (sheet thickness) measured by a V-bend test in accordance with JIS Z 2248 satisfies the following expression.

$$2.0 \geq R/t$$

Here,
R: limit bending radius (mm), and
t: sheet thickness of steel sheet (mm).

Solution to Problem

The inventors engaged in extensive studies and made the following discoveries.

(a) By controlling the area ratio of ferrite and retained austenite to each be 5% or more and the area ratio of martensite to be 10% or more, after preparing the chemical composition within a defined range, both high strength and excellent ductility are achievable.

(b) Bainite may be used to achieve high YR. Further, average solute C concentration of the retained austenite is increased, specifically controlled to be 0.5 mass % or more, by C concentration into austenite accompanying bainitic transformation. This stabilizes retained austenite and improves bendability.

(c) Reducing the concentration gradient (variation) in C concentration distribution in retained austenite, specifically, controlling the standard deviation in the C concentration distribution in retained austenite to be 0.250 mass % or less, provides excellent ductility.

(d) To reduce the concentration gradient (variation) of the C concentration distribution in retained austenite, it is important to appropriately control the distribution of Mn to untransformed austenite during annealing, and specifically, to satisfy the relationship in the following Formula (1).

$$[Mn]_\gamma/[Mn] \leq 1.20 \quad (1)$$

Here, $[Mn]_\gamma$: Mn concentration (mass %) in retained austenite, and

[Mn]: Mn content (mass %) in steel sheet chemical composition.

The present disclosure is based on these discoveries and further studies.

Primary features of the present disclosure are as follows.

1. A steel sheet comprising: a chemical composition containing (consisting of), in mass %, C: 0.09% or more and 0.20% or less,
Si: 0.3% or more and 1.5% or less,
Mn: 1.5% or more and 3.0% or less,
P: 0.001% or more and 0.100% or less,
S: 0.050% or less,
Al: 0.005% or more and 1.000% or less, and
N: 0.010% or less, with the balance being Fe and inevitable impurities: the steel microstructure comprising:

area ratio of ferrite: 5% or more and 65% or less,
area ratio of martensite: 10% or more and 60% or less,
area ratio of bainite: 10% or more and 60% or less, and
area ratio of retained austenite: 5% or more, wherein
the relationship of Formula (1) is satisfied,
average solute C concentration of the retained austenite $[C]_\gamma$ is 0.5 mass % or more, and
standard deviation of C concentration distribution in the retained austenite is 0.250 mass % or less, and
the steel sheet has a tensile strength of 780 MPa or more, $$[Mn]_\gamma/[Mn] \leq 1.20 \quad (1)$$

wherein $[Mn]_\gamma$ is Mn concentration, in mass %, in retained austenite, and

[Mn] is Mn content, in mass %, in the chemical composition of the steel sheet.

2. The steel sheet according to 1, above, wherein the chemical composition further contains, in mass %, at least one selected from the group consisting of:

Ti: 0.2% or less,
Nb: 0.2% or less,
B: 0.0050% or less,
Cu: 1.0% or less,
Ni: 0.5% or less,
Cr: 1.0% or less,
Mo: 0.3% or less,
V: 0.45% or less,
Zr: 0.2% or less,
W: 0.2% or less,
Sb: 0.1% or less,
Sn: 0.1% or less,
Ca: 0.0050% or less,
Mg: 0.01% or less, and
REM: 0.01% or less.

3. The steel sheet according to 1 or 2, above, further comprising a soft layer having a thickness of 1 μm or more and 50 μm or less, wherein the soft layer is a region where hardness is 65% or less of hardness at a ¼ sheet thickness position of the steel sheet.

4. The steel sheet according to any one of 1 to 3, above, further comprising a hot-dip galvanized layer on a surface.

5. A member made using the steel sheet according to any one of 1 to 4, above.

6. A method of producing a steel sheet, the method comprising:

a hot rolling process of hot rolling a steel slab having the chemical composition according to 1 or 2, above, to obtain a hot-rolled steel sheet, under a set of conditions including:
rolling finish temperature: 840° C. or more,
average cooling rate in a temperature range from the rolling finish temperature to 700° C.: 10° C./s or more, and
coiling temperature: 620° C. or less;
a cold rolling process of cold rolling the hot-rolled steel sheet to obtain a cold-rolled steel sheet:
a heating process of heating the cold-rolled steel sheet under a set of conditions satisfying the relationship of Formula (2) in a temperature range from 600° C. to 750° C.:
an annealing process of annealing the cold-rolled steel sheet, under a set of conditions including:
annealing temperature: 750° C. or more and 920° C. or less, and
annealing time: 1 s or more and 30 s or less:
a cooling process of cooling the cold-rolled steel sheet, under a set of conditions including:
average cooling rate in a temperature range from the annealing temperature to 550° C.: 10° C./s or more, and
cooling stop temperature: 400° C. or more and 550° C. or less; and
a holding process of holding the cold-rolled steel sheet in a temperature range of 400° C. or more and 550° C. or less for 15 s or more and 90 s or less, $$1000 \leq X \leq 7500 \quad (2)$$

where X is defined by the following formula

[Math. 1]

$$X = \log A \times \sum_{i=1}^{10} 1.05^{(T_i - 600)}$$

where

A is time in seconds that the cold-rolled sheet is held in the temperature range from 600° C. to 750° C. during the heating process, $T_i$ is average temperature in ° C. of the cold-rolled steel sheet during an i-th time period in a time sequence of time periods dividing A into 10 equal parts, and i is an integer from 1 to 10.

7. The method of producing a steel sheet according to 6, above, wherein the dew point of the atmosphere in the heating process and the annealing process is −35° C. or more.

8. The method of producing a steel sheet according to 6 or 7, above, further comprising a coating process after the holding process, in which hot-dip galvanizing treatment is performed.

9. A method of producing a member, wherein the steel sheet according to any one of 1 to 4, above, is subjected to at least one of a forming process and a joining process to produce the member.

Advantageous Effect

According to the present disclosure, a steel sheet that has high strength, excellent ductility, high YR, and excellent bendability is obtainable. Further, the steel sheet according to the present disclosure has high strength, excellent ductility, high YR, and excellent bendability, and therefore may be applied very advantageously as a material for automobile frame structural members and the like that have complex shapes.

DETAILED DESCRIPTION

The following describes embodiments of the present disclosure.

[1] Steel Sheet

First, the chemical composition of a steel sheet according to an embodiment of the present disclosure is described. Hereinafter, although the unit in all chemical compositions is "mass %", this may be indicated simply as "%", unless otherwise specified.

C: 0.09% or More and 0.20% or Less

C is included from the viewpoint of increasing strength of martensite and bainite and securing the desired TS and YR. Here, when C content is less than 0.09%, the area ratio of ferrite increases excessively, making obtaining a defined strength difficult. On the other hand, when the C content exceeds 0.20%, TS becomes excessively high and E1 decreases. Further, austenite stability increases and bainite formation becomes difficult. Further, martensite strength increases excessively, decreasing YR. The C content is therefore 0.09% or more and 0.20% or less. The C content is preferably 0.11% or more. The C content is more preferably 0.13% or more. Further, the C content is preferably 0.18% or less. The C content is more preferably 0.17% or less.

Si: 0.3% or More and 1.5% or Less

Si is an element that improves steel sheet strength by solid solution strengthening. Further, Si is an element that increases YR by increasing ferrite strength. Further, Si is an element that inhibits carbide precipitation during bainitic transformation, thereby promoting C concentration into austenite and facilitating the formation of retained austenite. To obtain these effects, Si content is 0.3% or more. On the other hand, excessive Si content, in particular exceeding 1.5%, causes a significant increase in rolling load during hot rolling and cold rolling, and also leads to a decrease in toughness. The Si content is therefore 0.3% or more and 1.5% or less. The Si content is preferably 0.4% or more. The Si content is more preferably 0.5% or more. The Si content is even more preferably 0.6% or more. Further, the Si content is preferably 1.3% or less. The Si content is more preferably 1.1% or less. The Si content is even more preferably 0.9% or less.

Mn: 1.5% or More and 3.0% or Less

Mn is included to improve the hardenability of the steel and to secure a defined range of area ratio of martensite and bainite. Here, when Mn content is less than 1.5%, hardenability is insufficient and ferrite and pearlite are excessively formed. Accordingly, achieving a TS of 780 MPa becomes difficult. Further, this leads to a decrease in YS and YR. On the other hand, excessive Mn content delays bainitic transformation, making obtaining a defined amount of bainite difficult. This leads to a decrease in YS and YR. Further, Mn is more likely to concentrate into austenite, leading to excessive increase in martensite strength and a decrease in YR. The Mn content is therefore 1.5% or more and 3.0% or less. The Mn content is preferably 1.6% or more. The Mn content is more preferably 1.7% or more. Further, the Mn content is preferably 2.8% or less. The Mn content is more preferably 2.6% or less.

P: 0.001% or More and 0.100% or Less

P is an element that acts as a solid solution strengthener and increases the TS and YS of steel sheets. To achieve this effect, P content is 0.001% or more. On the other hand, the P content exceeding 0.100% leads to a reduction in spot weldability. The P content is therefore 0.001% or more and 0.100% or less. In view of production technology constraints, the P content is preferably 0.002% or more. Further, the P content is preferably 0.010% or less. The P content is more preferably 0.006% or less.

S: 0.050% or Less

S forms MnS and the like, and reduces ductility. Further, when Ti is included together with S, then TiS, Ti(C, S), and the like may form, which may reduce hole expansion formability. The S content is therefore 0.050% or less. The S content is preferably 0.030% or less. The S content is more preferably 0.020% or less. The S content is even more preferably 0.002% or less. A lower limit of the S content is not particularly limited. In view of production technology constraints, the S content is preferably 0.0002% or more. The S content is more preferably 0.0005% or more.

Al: 0.005% or More and 1.000% or Less

Al is an element that promotes ferrite transformation in the annealing process and the cooling process after the annealing process. That is, Al is an element that affects the area ratio of ferrite. Here, when Al content is less than 0.005%, the area ratio of ferrite decreases and ductility is reduced. On the other hand, when the Al content exceeds 1.000%, the area ratio of ferrite increases excessively, and achieving a TS of 780 MPa or more becomes difficult. Further, this leads to a decrease in YS and YR. The Al content is therefore 0.005% or more and 1.000% or less. The Al content is preferably 0.015% or more. The Al content is more preferably 0.025% or more. Further, the Al content is preferably 0.500% or less. The Al content is more preferably 0.100% or less.

N: 0.010% or Less

N is an element that forms nitride precipitates such as AlN that pin crystal grain boundaries and may be included to improve elongation. However, when N content exceeds 0.010%, nitride precipitates such as AlN coarsen, and therefore elongation decreases. The N content is therefore 0.010% or less. The N content is preferably 0.005% or less. The N content is more preferably 0.0010% or less. A lower limit of the N content is not particularly limited. In view of production technology constraints, the N content is preferably 0.0006% or more.

Basic chemical composition of the steel sheet according to an embodiment of the present disclosure is described above. The steel sheet according to an embodiment of the present disclosure has a chemical composition including the basic composition above, with the balance being Fe (iron) and inevitable impurities. Here, the steel sheet according to an embodiment of the present disclosure preferably has a chemical composition consisting of the basic composition above, with the balance being Fe and inevitable impurities. In addition to the basic components described above, the steel sheet according to an embodiment of the present disclosure may contain one or more elements selected from at least one of the following groups A or B as optional additive elements.

(Group A)

Ti: 0.2% or less,
Nb: 0.2% or less,
B: 0.0050% or less,
Cu: 1.0% or less,
Ni: 0.5% or less,
Cr: 1.0% or less,
Mo: 0.3% or less,
V: 0.45% or less,
Zr: 0.2% or less, and
W: 0.2% or less.

(Group B)

Sb: 0.1% or less,
Sn: 0.1% or less,
Ca: 0.0050% or less,
Mg: 0.01% or less, and
REM: 0.01% or less.

There is no particular lower limit for the above optional additive elements, because the effect of the present disclosure is obtainable whenever content is equal to or less than the upper limit indicated above. When any of the above optional additional elements are included below a preferred lower limit described below, such an element is included as an inevitable impurity.

Ti: 0.2% or Less

Ti causes TS, YS, and YR to increase due to formation of fine carbides, nitrides, and carbonitrides during hot rolling and annealing. To obtain this effect, Ti content is preferably 0.001% or more. The Ti content is more preferably 0.005% or more. On the other hand, when the Ti content exceeds 0.2%, a large amount of coarse precipitates and inclusions form, leading to a decrease in E1. Therefore, when Ti is included, the Ti content is preferably 0.2% or less. The Ti content is more preferably 0.060% or less.

Nb: 0.2% or Less

Nb, like Ti, causes TS, YS, and YR to increase due to formation of fine carbides, nitrides, and carbonitrides during hot rolling and annealing. To obtain this effect, Nb content is preferably 0.001% or more. The Nb content is more preferably 0.005% or more. On the other hand, when the Nb content exceeds 0.2%, a large amount of coarse precipitates and inclusions form, leading to a decrease in E1. Therefore, when Nb is included, the Nb content is preferably 0.2% or less. The Nb content is more preferably 0.060% or less.

B: 0.0050% or Less

B is an element that increases hardenability by segregating at austenite grain boundaries. Further, B is an element that controls ferrite formation and grain growth during cooling after annealing. To obtain these effects, B content is preferably 0.0001% or more. The B content is more preferably 0.0002% or more. On the other hand, when the B content exceeds 0.0050%, the amount of nitride precipitates such as BN becomes excessive, and therefore E1 decreases. Therefore, when B is included, the B content is preferably 0.0050% or less. The B content is more preferably 0.0030% or less.

Cu: 1.0% or Less

Cu is an element that increases hardenability and promotes martensite formation, thereby increasing TS, YS, and YR. To obtain this effect, Cu content is preferably 0.005% or more. The Cu content is more preferably 0.020% or more. On the other hand, when the Cu content exceeds 1.0%, the area ratio of martensite may increase excessively and E1 may decrease. Further, large amounts of coarse precipitates and inclusions may be formed, resulting in a decrease in E1. Therefore, when Cu is included, the Cu content is preferably 1.0% or less. The Cu content is more preferably 0.2% or less.

Ni: 0.5% or Less

Ni is an element that increases hardenability and promotes martensite formation, thereby increasing TS, YS, and YR. To obtain this effect, Ni content is preferably 0.005% or more. The Ni content is more preferably 0.020% or more. On the other hand, when the Ni content exceeds 0.5%, the area ratio of martensite may increase and E1 may decrease. Therefore, when Ni is included, the Ni content is preferably 0.5% or less. The Ni content is more preferably 0.2% or less.

Cr: 1.0% or Less

Cr is an element that increases hardenability and promotes martensite formation, thereby increasing TS, YS, and YR. To obtain these effects, Cr content is preferably 0.0005% or more. Further, the Cr content is more preferably 0.010% or more. On the other hand, when the Cr content exceeds 1.0%, the area ratio of martensite may increase and E1 may decrease. Therefore, when Cr is included, the Cr content is preferably 1.0% or less. Further, the Cr content is more preferably 0.25% or less. The Cr content is even more preferably 0.10% or less.

Mo: 0.3% or Less

Mo is an element that increases hardenability and promotes martensite formation, thereby increasing TS, YS, and YR. To obtain this effect, Mo content is preferably 0.010% or more. The Mo content is more preferably 0.030% or more. On the other hand, when the Mo content exceeds 0.3%, the area ratio of martensite may increase and the desired E1 may not be obtainable. Therefore, when Mo is included, the Mo content is preferably 0.3% or less. The Mo content is more preferably 0.20% or less. The Mo content is even more preferably 0.15% or less.

V: 0.45% or Less

V, like Nb and Ti, causes TS and YS to increase due to formation of fine carbides, nitrides, and carbonitrides during hot rolling and annealing. To obtain this effect, V content is preferably 0.001% or more. The V content is more preferably 0.005% or more. On the other hand, when the V content exceeds 0.45%, a large amount of coarse precipitates and inclusions may form, and E1 may decrease. Therefore, when Vis included, the V content is preferably 0.45% or less. The V content is more preferably 0.060% or less.

Zr: 0.2% or Less

Zr contributes to higher strength through the refinement of prior γ grain size and a resulting reduction of block size, bain unit size, and the like, which are internal structural units of martensite and bainite. Further, Zr improves castability. To obtain these effects, Zr content is preferably 0.001% or more. However, including a large amount of Zr increases coarse precipitates of ZrN and ZrS that remain in non-solid solution when the slab is heated prior to hot rolling, and decreases El. Therefore, when Zr is included, the Zr content is preferably 0.2% or less. The Zr content is more preferably 0.05% or less. The Zr content is even more preferably 0.01% or less.

W: 0.2% or Less

W, like Ti and Nb, causes TS, YS, and YR to increase due to formation of fine carbides, nitrides, and carbonitrides during hot rolling and annealing. To obtain these effects, W content is preferably 0.001% or more. The W content is more preferably 0.005% or more. On the other hand, when the W content exceeds 0.2%, large amounts of coarse precipitates and inclusions form, leading to a decrease in El. Therefore, when W is included, the W content is preferably 0.2% or less. The W content is more preferably 0.060% or less.

Sb: 0.1% or Less

Sb is an element effective for inhibiting diffusion of C in the vicinity of the steel sheet surface during annealing and for controlling the formation of a soft layer in the vicinity of the steel sheet surface. Here, when the soft layer increases excessively in the vicinity of the steel sheet surface, achieving a TS of 780 MPa or more may be difficult, and this may also lead to a decrease in YS. Therefore, Sb content is preferably 0.002% or more. The Sb content is more preferably 0.005% or more. On the other hand, when the Sb content exceeds 0.1%, castability is reduced. Therefore, when Sb is included, the Sb content is preferably 0.1% or less. The Sb content is more preferably 0.06% or less. The Sb content is even more preferably 0.04% or less.

Sn: 0.1% or Less

Sn inhibits oxidation and nitridation in the vicinity of the steel sheet surface, thereby reducing the C and B content in the vicinity of the steel sheet surface. Accordingly, excessive ferrite formation in the vicinity of the steel sheet surface is inhibited, contributing to a TS of 780 MPa or more. In view of this, Sn content is preferably 0.002% or more. However, when the Sn content exceeds 0.1%, castability is reduced. Therefore, when Sn is included, the Sn content is preferably 0.1% or less. The Sn content is more preferably 0.04% or less. The Sn content is even more preferably 0.02% or less.

Ca: 0.0050% or Less

Ca is present in steel as inclusions. When Ca content exceeds 0.0050%, a large amount of coarse inclusions may form and El may decrease. Further, surface quality and bendability are reduced. Therefore, when Ca is included, the Ca content is preferably 0.0050% or less. A lower limit of the Ca content is not particularly limited. The Ca content is preferably, for example, 0.0005% or more.

Mg: 0.01% or Less

Mg is an effective element for spheroidizing the shape of inclusions such as sulfides and oxides, and for improving hole expansion formability and bendability of steel sheets. To obtain these effects, Mg content is preferably 0.0001% or more. However, when the Mg content exceeds 0.01%, surface quality and bendability deteriorate. Therefore, when Mg is included, the Mg content is preferably 0.01% or less. The Mg content is more preferably 0.005% or less. The Mg content is even more preferably 0.001% or less.

REM: 0.01% or Less

REM (rare earth metals) are elements that improve bendability by refining inclusions and reducing fracture initiation points. To obtain this effect, REM content is preferably 0.0002% or more. However, when the REM content exceeds 0.01%, inclusions instead become coarser, and El and bendability decrease. Therefore, when REM is included, the REM content is preferably 0.01% or less. The REM content is more preferably 0.004% or less. The REM content is even more preferably 0.002% or less.

Elements other than those described above are Fe and inevitable impurities.

Next, the steel microstructure of the steel sheet according to an embodiment of the present disclosure is described.

The steel microstructure of the steel sheet according to an embodiment of the present disclosure includes:

area ratio of ferrite: 5% or more and 65% or less, area ratio of martensite: 10% or more and 60% or less, area ratio of bainite: 10% or more and 60% or less, and area ratio of retained austenite: 5% or more.

Further, the relationship of Formula (1) is satisfied, average solute C concentration of the retained austenite $[C]_\gamma$ is 0.5 mass % or more, and standard deviation of C concentration distribution in the retained austenite is 0.250 mass % or less.

$$[Mn]_\gamma/[Mn] \leq 1.20 \quad (1)$$

Here, $[Mn]_\gamma$: Mn concentration (mass %) in retained austenite, and

[Mn]: Mn content (mass %) in the chemical composition of the steel sheet.

The reasons for each of these limitations are described below. Area ratio indicates the ratio of the area of each metallic phase to the area of the steel microstructure overall.

Area Ratio of Ferrite: 5% or More and 65% or Less

Ferrite is soft and therefore effective in obtaining excellent ductility. The area ratio of ferrite is therefore 5% or more. When the area ratio of ferrite is less than 5%, martensite and bainite increase excessively and El is reduced. The area ratio of ferrite is preferably 10% or more. On the other hand, when the area ratio of ferrite exceeds 65%, the desired TS is not obtainable. Further, YS and YR decrease. The area ratio of ferrite is therefore 65% or less.

Area Ratio of Martensite: 10% or More and 60% or Less

Martensite is hard and is a necessary microstructure for strengthening steel sheets. Here, when the area ratio of martensite is less than 10%, the desired TS is not obtainable. On the other hand, excessive increase in the area ratio of martensite may cause a decrease in El. Accordingly, the area ratio of martensite is 10% or more and 60% or less. The area ratio of martensite is preferably 50% or less.

Martensite is a hard microstructure formed by transformation from austenite at the martensitic transformation temperature (also referred to simply as the Ms point) or less. Further, martensite includes both so-called fresh martensite, which is still quenched, and so-called tempered martensite, where fresh martensite has been tempered.

Area Ratio of Bainite: 10% or More and 60% or Less

Bainite is a microstructure necessary for obtaining the desired YR. The area ratio of bainite is therefore 10% or more. The area ratio of bainite is preferably 15% or more. The area ratio of bainite is more preferably 20% or more. On the other hand, excessive increase of bainite results in a decrease in El. The area ratio of bainite is therefore 60% or less. The area ratio of bainite is preferably 55% or less. The area ratio of bainite is more preferably 50% or less.

Bainite is a hard microstructure consisting of fine carbides dispersed in needle or plate-like ferrite. Further, bainite forms from austenite at relatively low temperatures (the martensitic transformation temperature or more).

Area Ratio of Retained Austenite: 5% or More

Retained austenite is a microstructure necessary for both strength and ductility. Here, when the area ratio of retained austenite is less than 5%, both strength and ductility are not achievable. The area ratio of retained austenite is therefore 5% or more. The area ratio of retained austenite is preferably 6% or more. An upper limit of the area ratio of retained austenite is not specified. When the retained austenite is excessive, the retained austenite transforms to martensite when the steel sheet is formed into component, for example, and initiation points of bending cracks increase. Therefore, the area ratio of retained austenite is preferably 20% or less. The area ratio of retained austenite is more preferably 15% or less.

Retained austenite is austenite retained without transforming from austenite to ferrite, martensite, bainite, or another metal phase. Further, retained austenite is formed when the martensitic transformation temperature is room temperature or less, due to the concentration of elements such as Cin austenite.

The area ratio of residual microstructure other than described above is preferably 10.0% or less. The area ratio of the residual microstructure is more preferably 5.0% or less. Further, the area ratio of the residual microstructure may be 0%.

The residual microstructure is not particularly limited, and may include pearlite, and carbides such as cementite, for example. The type of residual microstructure can be confirmed, for example, by observation with a scanning electron microscope (SEM). Pearlite is a microstructure formed from austenite at relatively high temperatures and is composed of layered ferrite and cementite.

Here, the area ratios of ferrite, martensite, and bainite are measured at the ¼ sheet thickness position of the steel sheet as follows.

A sample is cut from the steel sheet such that a thickness cross-section parallel to the rolling direction of the steel sheet (L-section) becomes an observation plane. The observation plane of the sample is then polished using diamond paste, followed by finish polishing of the observation plane of the sample using alumina. The observation plane of the sample is then etched with nital to reveal the microstructure.

The observation plane of the sample is then observed using a scanning electron microscope (SEM) at a magnification of 1500× for five fields of view. From the obtained microstructure images, the following areas are color-coded (demarcated) using Adobe Photoshop by Adobe Systems Inc., and the areas of ferrite, martensite, and bainite are calculated.

Ferrite: a black area, blocky in morphology. Further, ferrite is a microstructure consisting of crystal grains of the bcc lattice. Ferrite is formed by transformation from austenite at relatively high temperatures.

Martensite: a white to light gray area. Further, martensite is a hard microstructure formed by transformation from austenite at the Ms point or less, as mentioned above. Martensite includes both so-called fresh martensite, which is still quenched, and so-called tempered martensite, where fresh martensite has been tempered.

Bainite: a black to dark gray area, which may be blocky or irregular in morphology. Further, as mentioned above, bainite is a hard microstructure consisting of fine carbides dispersed in needle or plate-shaped ferrite. Bainite forms from austenite at relatively low temperatures (the Ms point or more). Further, bainite includes a relatively small number of carbides.

Further, the area ratio of retained austenite is measured at the ¼ sheet thickness position of the steel sheet as follows.

The steel sheet is machine ground in the thickness direction (depth direction) to the ¼ sheet thickness position, and then chemically polished with oxalic acid to prepare the observation plane. The observation plane is then observed by X-ray diffraction. CoKα radiation is used for incident X-rays to determine a ratio of diffraction intensity of the (200), (220), and (311) planes of fcc iron (austenite) to diffraction intensity of the (200), (211), and (220) planes of bcc iron. The volume fraction of retained austenite is then calculated from the ratio of the diffraction intensity of each plane. Then, assuming that the retained austenite is uniform in three dimensions, the volume fraction of the retained austenite is taken as the area ratio of retained austenite.

Further, the area ratio of the residual microstructure is determined by subtracting the area ratios of ferrite, martensite, bainite, and retained austenite determined as described above from 100%.

$$[\text{area ratio of residual microstructure (\%)}] = 100 - [\text{area ratio of ferrite (\%)}] - [\text{area ratio of martensite (\%)}] - [\text{area ratio of bainite (\%)}] - [\text{area ratio of retained austenite (\%)}]$$

$$[Mn]_\gamma/[Mn] \leq 1.20 \quad (1)$$

In the steel sheet according to an embodiment of the present disclosure, satisfying Formula (1), above, is important. $[Mn]_\gamma/[Mn]$ means the ratio of the Mn concentration of retained austenite (mass %) to the Mn content (mass %) of the chemical composition of the steel sheet (corresponding to the average Mn concentration of the steel sheet). The high $[Mn]_\gamma/[Mn]$ means that Mn has been concentrated into austenite in the annealing process. The Mn concentration of austenite in the steel sheet immediately after the annealing process is one of the factors that determine whether a phase transformed from austenite becomes bainite or martensite during the cooling process after annealing and during the holding process after the cooling process. Here, excessive concentration of Mn in austenite may delay bainitic transformation, which may result in reduced YS and YR because the desired area ratio of bainite is not obtained. Further, delay of bainitic transformation inhibits C concentration into austenite. Therefore, sufficient retained austenite, which contributes to improved ductility, is not obtainable. Accordingly, $[Mn]_\gamma/[Mn]$ is 1.20 or less. $[Mn]_\gamma/[Mn]$ is preferably 1.15 or less. A lower limit of $[Mn]_\gamma/[Mn]$ is 1.00, because Mn is expelled from ferrite and concentrated into austenite.

The Mn concentration of retained austenite $[Mn]_\gamma$ is determined by observation in the same field of view by an electron probe micro-analyzer (EPMA) and electron backscatter diffraction (EBSD) attached to a field emission scanning electron microscope (FE-SEM).

A sample is cut from the steel sheet such that a thickness cross-section parallel to the rolling direction of the steel sheet (L-section) becomes an observation plane. The observation plane of the sample is then polished using diamond paste. The observation plane of the sample is then finish polished using alumina. The Mn concentration is then measured in a grid pattern with a measurement interval of 0.1 μm in an area of 23 μm square by EPMA, with the observation position set at the ¼ sheet thickness position of the steel sheet. The area of retained austenite is then extracted from the EBSD phase map, and the average value of Mn concentration at each measurement point in the area of retained austenite is determined as $[Mn]_\gamma$.

Average Solute C Concentration of Retained Austenite $[C]_\gamma$: 0.5 Mass % or More In the steel sheet according to an embodiment of the present disclosure, the average solute C concentration of retained austenite $[C]_\gamma$ being 0.5 mass % or more is important. In other words, the higher $[C]_\gamma$ is, the more stable the retained austenite is, and a better balance between strength and ductility is obtainable. When $[C]_\gamma$ is less than 0.5 mass %, a good balance between strength and ductility is not obtainable. Further, low stability of retained austenite causes, for example, an increase in retained austenite that undergoes martensitic transformation when the steel sheet is formed into components, resulting in reduced bendability. $[C]_\gamma$ is therefore 0.5 mass % or more. $[C]_\gamma$ is preferably 0.6 mass % or more. $[C]_\gamma$ is more preferably 0.7 mass % or more. An upper limit of $[C]_\gamma$ is not particularly limited. However, when $[C]_\gamma$ is excessively high, transformation from retained austenite to martensite that occurs with tensile deformation may not progress sufficiently, and therefore, sufficient strain hardenability may not be obtainable. Accordingly, $[C]_\gamma$ is preferably 2.0 mass % or less.

Further, average solute C concentration of retained austenite $[C]_\gamma$ is calculated as follows.

The lattice constant of austenite ($\alpha\gamma$) is calculated from the peak angle of (220) of fcc iron (austenite) used in the measurement of the area ratio of retained austenite. $[C]_\gamma$ is then calculated by the following formula.

$$\alpha\gamma = 3.578 + 0.00095\,(\%\,Mn) + 0.022\,(\%\,N) + 0.0056\,(\%\,Al) + 0.033\,[C]_\gamma$$

Here, (% Mn), (% N), and (% Al) are the content (mass %) of Mn, N, and Al, respectively, in the chemical composition of the steel sheet.

Standard Deviation of C Concentration Distribution in Retained Austenite: 0.250 Mass % or Less In the steel sheet according to an embodiment of the present disclosure, the standard deviation of C concentration distribution in retained austenite being 0.250 mass % or less is important. That is, a large standard deviation of C concentration distribution in retained austenite indicates a large gradient (variation) of C concentration in the retained austenite. When the gradient of C concentration is large, then when the steel sheet is formed into a component, for example, a portion with low C concentration undergoes martensitic transformation during forming, and ductility is not obtainable. Accordingly, making C concentration distribution in retained austenite as uniform as possible is important. Therefore, the standard deviation of C concentration distribution in retained austenite is 0.250 mass % or less. The standard deviation of C concentration distribution in retained austenite is preferably 0.200 mass % or less. A lower limit of the standard deviation of C concentration distribution in retained austenite is not particularly limited and may be 0 mass %. Further, from the viewpoint of making C concentration distribution in retained austenite as uniform as possible, promoting C concentration into austenite due to bainitic transformation is effective. Further, in order to promote bainitic transformation, inhibiting Mn concentration into austenite is effective, as mentioned above.

The standard deviation of C concentration distribution in retained austenite is determined by observation in the same field of view by an electron probe micro-analyzer (EPMA) and electron backscatter diffraction (EBSD) attached to a FE-SEM.

A sample is cut from the steel sheet such that a thickness cross-section parallel to the rolling direction of the steel sheet (L-section) becomes an observation plane. The observation plane of the sample is then polished using diamond paste. The observation plane of the sample is then finish polished using alumina. The C concentration is then measured in a grid pattern with a measurement interval of 0.1 μm in an area of 23 μm square by EPMA, with the observation position set at the ¼ sheet thickness position of the steel sheet. The area of retained austenite is then extracted from the EBSD phase map, and the standard deviation of C concentration distribution in retained austenite is calculated from C concentration at each measurement point in the area of retained austenite.

Further, the steel sheet according to an embodiment of the present disclosure preferably includes a soft layer having thickness of 1 μm or more and 50 μm or less. In particular, a soft layer having a thickness of 1 μm or more and 50 μm or less in the thickness direction from the steel sheet surface provides better bendability. Accordingly, a soft layer in the thickness direction from the steel sheet surface is preferable, and the thickness of the soft layer is preferably 1 μm or more. However, when an excessive amount of soft layer is formed, obtaining the desired TS becomes difficult. Therefore, when a soft layer is included, the thickness of the soft layer is preferably 50 μm or less. The thickness of the soft layer is more preferably 40 μm or less.

Here, the soft layer is a region where hardness is 65% or less of hardness at the ¼ sheet thickness position of the steel sheet. Further, the thickness of the soft layer is measured as follows.

A sheet thickness section parallel to the rolling direction of the steel sheet (L section) is smoothed by wet polishing. Then, using a Vickers hardness tester and under a load of 10 gf, hardness is measured at 1 μm intervals in the thickness (depth) direction from a position 1 μm deep from the surface of the steel sheet to a position 100 μm deep. Further, under the same conditions, hardness is measured at 20 μm intervals in the thickness (depth) direction from a position 100 μm deep from the surface of the steel sheet to a mid-thickness position. The hardness obtained at the ¼ sheet thickness position of the steel sheet is used as a reference hardness, and a depth position where the hardness is 65% of the reference hardness or less towards the surface from the ¼ sheet thickness position is identified. The distance (depth) from the surface of the steel sheet to the deepest depth position where the hardness is 65% of the reference hardness or less is measured, and the measured value is the thickness of the soft layer.

The steel microstructure of a steel sheet is typically approximately vertically symmetrical in the thickness direction, and therefore any one surface (front or back) of the steel sheet is representative in the measurement of the thickness of the soft layer. For example, any one surface (front or back) of the steel sheet may be used as the starting point for a sheet thickness position (thickness 0 position), such as the ¼ sheet thickness position. When a soft layer is only present on one side of the steel sheet, the side on which the soft layer is present is the starting point for the sheet thickness position (thickness 0 position). Further, the thickness of the soft layer is the thickness per surface. The same applies hereinafter.

Mechanical properties of the steel sheet according to an embodiment of the present disclosure are described below.

Tensile Strength (TS): 780 MPa or More

Tensile strength of the steel sheet according to an embodiment of the present disclosure is 780 MPa or more.

Total elongation (El), uniform elongation (U.El), yield stress (YS) and R (limit bending radius)/t (sheet thickness of steel sheet) of the steel sheet according to an embodiment of the present disclosure are as described above. Further, tensile strength (TS), total elongation (El), uniform elongation (U.El), yield stress (YS) and R (limit bending radius)/t (sheet thickness of steel sheet) are measured as described below in the EXAMPLES section.

Further, the steel sheet according to an embodiment of the present disclosure may include a hot-dip galvanized layer on the surface. The hot-dip galvanized layer may be on only one surface of the steel sheet or may be on both surfaces. The hot-dip galvanized layer refers to a coated or plated layer in which Zn is the main component (Zn content of 50.0 mass % or more).

Here, for example, the hot-dip galvanized layer being composed of Zn, Fe: 20.0 mass % or less, and Al: 0.001 mass % or more and 1.0 mass % or less is appropriate. Further, the hot-dip galvanized layer may optionally contain one or more elements selected from the group consisting of Pb, Sb, Si, Sn, Mg, Mn, Ni, Cr, Co, Ca, Cu, Li, Ti, Be, Bi, and REM, totaling 0.0 mass % or more and 3.5 mass % or less. Further, the Fe content of the hot-dip galvanized layer is more preferably less than 7.0 mass %. Other than the above elements, the balance is inevitable impurities.

Further, a coating weight per side of the hot-dip galvanized layer is not particularly limited. The coating weight per side of the galvanized layer is preferably 20 g/m$^2$ to 80 g/m$^2$.

The coating weight of the hot-dip galvanized layer is measured as follows.

A coating solution is prepared by adding 0.6 g of a corrosion inhibitor for Fe ("IBIT® 700BK" (IBIT is a registered trademark in Japan, other countries, or both) manufactured by Asahi Chemical Co., Ltd.) to 1 L of a 10 mass % hydrochloric acid aqueous solution. The steel sheet to be the test piece is then immersed in the coating solution to dissolve the hot-dip galvanized layer. Mass loss of the test piece before and after dissolving is measured, and the value is divided by the surface area of the steel sheet (surface area of a coated portion) to calculate the coating weight (g/m$^2$).

The thickness of the steel sheet according to an embodiment of the present disclosure is not particularly limited. The thickness of the steel sheet is preferably 0.5 mm or more. The thickness of the steel sheet is preferably 3.5 mm or less.

[2] Member

A member according to an embodiment of the present disclosure is described below.

The member according to an embodiment of the present disclosure is a member made using the steel sheet described above as a material. For example, the material, the steel sheet, is subjected to at least one of a forming process and a joining process to make the member.

Here, the steel sheet has a TS of 780 MPa or more, and has high YR and excellent press formability (excellent ductility and excellent bendability). Therefore, the member according to an embodiment of the present disclosure has high strength and is particularly suitable for application as a complex-shape member for use in the automobile field.

[3] Method of Producing Steel Sheet

The following describes a method of producing a steel sheet according to an embodiment of the present disclosure.

The method of producing a steel sheet according to an embodiment of the present disclosure includes:

a hot rolling process of hot rolling a steel slab having the chemical composition described above to obtain a hot-rolled steel sheet, under a set of conditions including:

rolling finish temperature: 840° C. or more, average cooling rate in a temperature range from the rolling finish temperature to 700° C.: 10° C./s or more, and coiling temperature: 620° C. or less:

a cold rolling process of cold rolling the hot-rolled steel sheet to obtain a cold-rolled steel sheet:

a heating process of heating the cold-rolled steel sheet under a set of conditions satisfying the relationship of Formula (2) in a temperature range from 600° C. to 750° C.:

an annealing process of annealing the cold-rolled steel sheet, under a set of conditions including:

annealing temperature: 750° C. or more and 920° C. or less, and annealing time: 1 s or more and 30 s or less:

a cooling process of cooling the cold-rolled steel sheet, under a set of conditions including:

average cooling rate in a temperature range from the annealing temperature to 550° C.: 10° C./s or more, and cooling stop temperature: 400° C. or more and 550° C. or less; and a holding process of holding the cold-rolled steel sheet in a temperature range of 400° C. or more and 550° C. or less for 15 s or more and 90 s or less.

$$1000 \leq X \leq 7500 \quad (2)$$

Here, X is defined by the following formula $$X = \log A \times \sum_{i=1}^{10} 1.05^{(T_i - 600)} \quad \text{[Math. 2]}$$

Here,

A is time in seconds that the cold-rolled steel sheet is held in the temperature range from 600° C. to 750° C. during the heating process, $T_i$ is average temperature in ° C. of the cold-rolled steel sheet during an i-th time period in a time sequence of time periods dividing A into 10 equal parts, and i is an integer from 1 to 10.

Unless otherwise specified, each of temperatures above refers to a surface temperature of the steel slab or the steel sheet.

First, a steel slab having the chemical composition described above is prepared. For example, steel material is melted to produce molten steel having the chemical composition described above. The steelmaking method is not particularly limited, and any known steelmaking method may be used, such as using a converter, electric furnace, and the like. Obtained molten steel is then solidified into a steel slab. The method of obtaining a steel slab from molten steel is not particularly limited. For example, continuous casting, ingot making, and thin slab casting methods may be used. A continuous casting method is preferred from the viewpoint of hindering macro-segregation. Further, a conventional method may be applied in which the steel slab thus produced may be cooled to room temperature and then reheated. Further, an energy saving process may be applied, such as hot charging (where a steel slab is charged into a heating furnace as a warm slab without cooling to room temperature and then hot rolled) and direct rolling (where a steel slab is hot rolled immediately after being subjected to temperature holding for a short period). When the steel slab is heated, the slab heating temperature is preferably 1100° C. or more from a viewpoint of carbide dissolution and reduction of rolling load. Further, the slab heating temperature is preferably 1300° C. or less, in order to prevent increased scale loss. The slab heating temperature is the temperature of the slab surface. Further, the slab is made into a sheet bar by rough rolling under typical conditions. However, when the heating temperature is low, heating the sheet bar using a bar heater or the like before finish rolling is preferable, from the viewpoint of preventing trouble during hot rolling.

[Hot Rolling Process]

The steel slab is then hot rolled to obtain a hot-rolled steel sheet. In this hot rolling process, satisfying the following conditions is important.

Rolling Finish Temperature: 840° C. or More

When the rolling finish temperature is less than 840° C., ferrite formation is promoted and excessive ferrite is formed before the hot-rolled steel sheet is coiled. This results in C concentration into untransformed austenite. Excessive C concentration into untransformed austenite promotes pearlitic transformation, resulting in excessive formation of pearlite in the steel microstructure of hot-rolled steel sheets obtained after hot rolling. Pearlite is a layered microstructure of ferrite and cementite, with Mn concentrated in the cementite. From the viewpoint of inhibiting Mn concentration into retained austenite in the steel microstructure of the final product, inhibiting Mn concentration (variation in Mn concentration) in the microstructure of the steel sheet before the annealing process is also important. The rolling finish temperature is therefore 840° C. or more. The rolling finish temperature is preferably 850° C. or more. An upper limit of the rolling finish temperature is not particularly limited. The rolling finish temperature is preferably 950° C. or less, as a higher temperature may be difficult to cool to a coiling temperature described later. The rolling finish temperature is more preferably 920° C. or less.

Average Cooling Rate in a Temperature Range from the Rolling Finish Temperature to 700° C. (Hereinafter Also Referred to as a First Average Cooling Rate): 10° C./s or More A slower first average cooling rate leads to excessive ferrite formation during cooling and C concentration into untransformed austenite. Excessive C concentration into untransformed austenite promotes pearlitic transformation, resulting in excessive formation of pearlite in the steel microstructure of hot-rolled steel sheets obtained after hot rolling. As mentioned above, pearlite is a layered microstructure of ferrite and cementite, with Mn concentrated in the cementite. From the viewpoint of inhibiting Mn concentration into retained austenite in the steel microstructure of the final product, inhibiting Mn concentration (variation in Mn concentration) in the microstructure of the steel sheet before the annealing process is also important. The first average cooling rate is therefore 10° C./s or more. The first average cooling rate is preferably 15° C./s or more. An upper limit of the first average cooling rate is not particularly limited. From the viewpoint of cooling facility energy savings, the first average cooling rate is preferably 1000° C./s or less.

Coiling Temperature: 620° C. or Less

When the coiling temperature exceeds 620° C., excessive amounts of pearlite occurs and Mn concentration is promoted during coiling. The lower the coiling temperature, the less pearlite is formed, and therefore lower coiling temperatures are preferred. The coiling temperature is therefore 620° C. or less. The coiling temperature is preferably 600° C. or less. The coiling temperature is more preferably 580° C. or less. On the other hand, when the coiling temperature is less than 400° C., the steel sheet may become excessively hardened, causing fracture during cold rolling. Therefore, the coiling temperature is preferably 400° C. or more. The coiling temperature is more preferably 450° C. or more.

Descaling may be performed as appropriate to remove primary scale and secondary scale formed on the surface of the hot-rolled steel sheet. Before cold rolling the hot-rolled steel sheet, sufficient pickling to reduce scale residue may be performed. Further, from the viewpoint of load reduction during cold rolling, the hot-rolled steel sheet may optionally be subjected to hot-rolled sheet annealing.

[Cold Rolling Process]

The hot-rolled steel sheet is then subjected to cold rolling to obtain a cold-rolled steel sheet. The rolling reduction of the cold rolling is not particularly limited. The rolling reduction of the cold rolling is preferably 20% or more. The rolling reduction of the cold rolling is preferably 80% or less. When the rolling reduction of the cold rolling is less than 20%, coarsening and non-uniformity of the steel microstructure is more likely to occur during the annealing process, which may result in reduced TS and bendability in the final product. On the other hand, when the rolling reduction of the cold rolling exceeds 80%, the steel sheet may be prone to shape defects.

[Heating Process]

The cold-rolled steel sheet is then heated to the annealing temperature. At this time, in the temperature range from 600° C. to 750° C., heating under a set of conditions satisfying the relationship of Formula (2) is important.

$$1000 \leq X \leq 7500 \quad (2)$$

Here, X is defined by the following formula:

$$X = \log A \times \sum_{i=1}^{10} 1.05^{(T_i - 600)} \quad \text{[Math. 3]}$$

Here,

A is time in seconds that the cold-rolled steel sheet is held in the temperature range from 600° C. to 750° C. during the heating process, $T_i$ is average temperature in ° C. of the cold-rolled steel sheet during an i-th time period in a time sequence of time periods dividing A into 10 equal parts, and i is an integer from 1 to 10.

$$1000 \leq X \leq 7500 \quad (2)$$

The less time that the cold-rolled steel sheet is in the temperature range from 600° C. to 750° C. (hereinafter also referred to as the heating temperature range) during the heating process, the more Mn diffuses and concentration of Mn into austenite is inhibited. Further, the longer the time in a high temperature range of the heating temperature range described above, the more Mn concentration into austenite is promoted. Accordingly, shortening the time in the high temperature range is effective. This may promote bainitic transformation and improve YR and ductility. X is therefore 7500 or less. X is preferably 6000 or less. X is more preferably 5000 or less. However, from the viewpoint of allowing C to concentrate in austenite to finally produce retained austenite, a longer time in the heating temperature range is preferable. X is therefore 1000 or more. X is preferably 1300 or more.

$T_i$ is Calculated as Follows.

The time that the cold-rolled steel sheet is in the temperature range from 600° C. to 750° C. during the heating process (in other words, the time required to raise the temperature of the cold-rolled steel sheet from 600° C. to 750° C.) is divided equally into 10 time periods. The average temperature of the cold-rolled steel sheet is then calculated from time-integrated values of the surface temperature of the cold-rolled steel sheet for each of the 10 equally divided time periods. Each time-integrated value of the surface temperature is, for example, a value obtained by measuring the surface temperature of the cold-rolled steel sheet during the heating process with a radiation thermometer. In addition, by calculating backward from the actual heat to which the steel sheet is exposed, taking into account the line speed, the thermal hysteresis of the steel sheet may be determined. Ti may be calculated from the relationship between temperature and time.

Dew Point of Atmosphere: −35° C. or More

From the viewpoint of forming a soft layer of a desired thickness in the thickness direction from the steel sheet surface and obtaining excellent bendability, the dew point of the atmosphere in the heating process is preferably −35° C. or more. When the dew point of the atmosphere is less than −35° C., forming a soft phase with the desired thickness becomes difficult. Therefore, the dew point of the atmosphere during the heating process is preferably −35° C. or more. The dew point of the atmosphere during the heating process is more preferably −20° C. or more. The dew point of the atmosphere during the heating process is even more preferably −10° C. or more. An upper limit of the dew point of the atmosphere in the heating process is not particularly limited. In order to keep TS within a suitable range, the dew point of the atmosphere in the heating process is preferably 15° C. or less. The dew point of the atmosphere during the heating process is more preferably 5° C. or less.

[Annealing Process]

The cold-rolled steel sheet is then annealed under a set of conditions including an annealing temperature of 750° C. or more and 920° C. or less and an annealing time of 1 s or more and 30 s or less.

Annealing Temperature: 750° C. or More and 920° C. or Less

When the annealing temperature is less than 750° C., the ratio of austenite formation during heating in the two-phase region of ferrite and austenite is insufficient. As a result, the area ratio of ferrite increases excessively after annealing, and the desired TS and YR are not obtainable. On the other hand, when the annealing temperature exceeds 920° C., the desired area ratio of ferrite is not obtainable and ductility is reduced. The annealing temperature is therefore 750° C. or more and 920° C. or less. The annealing temperature is preferably 880° C. or less. The annealing temperature is the maximum arrival temperature during the annealing process.

Annealing Time: 1 s or More and 30 s or Less

In the method of producing a steel sheet according to an embodiment of the disclosure, the annealing time is important to control the Mn concentration of austenite during annealing. That is, the shorter the annealing time, the better, from the viewpoint of inhibiting Mn concentration into austenite during annealing, promoting bainitic transformation, and promoting C concentration into retained austenite. The annealing time is therefore 30 s or less. The annealing time is preferably 25 s or less. The annealing time is more preferably 20 s or less. On the other hand, when the annealing time is less than 1 s, coarse Fe-based precipitates do not dissolve, resulting in decreased elongation. The annealing time is therefore 1 s or more. The annealing time is preferably 5 s or more. The annealing time is the hold time at the annealing temperature.

Dew Point of Atmosphere: −35° C. or More

From the viewpoint of forming a soft layer of desired thickness in the thickness direction from the steel sheet surface and obtaining excellent bendability, the dew point of the atmosphere in the annealing process is also preferably −35° C. or more, following the heating process described above. When the dew point of the atmosphere is less than −35° C., forming a soft phase with the desired thickness becomes difficult. Therefore, the dew point of the atmosphere during the annealing process is preferably −35° C. or more. The dew point of the atmosphere during the annealing process is more preferably −20° C. or more. The dew point of the atmosphere during the annealing process is even more preferably −10° C. or more. An upper limit of the dew point of the atmosphere in the annealing process is not particularly limited. In order to keep TS within a suitable range, the dew point of the atmosphere in the annealing process is preferably 15° C. or less. The dew point of the atmosphere during the annealing process is more preferably 5° C. or less.

[Cooling Process]

The cold-rolled steel sheet is then cooled after the annealing as described above.

Average Cooling Rate in Temperature Range from Annealing Temperature to 550° C.: 10° C./s or More In order to form bainite in the cooling process, the cooling rate, in particular the average cooling rate in the temperature range from the annealing temperature to 550° C. (hereinafter also referred to as the second average cooling rate), needs to be appropriately controlled. When the second average cooling rate is slow, excessive ferrite formation occurs. In addition, an excess of pearlite is also formed, TS decreases, and appropriate amounts of bainite and retained austenite become unobtainable. The second average cooling rate is therefore 10° C./s or more. The second average cooling rate is preferably 12° C./s or more. An upper limit of the second average cooling rate is not particularly limited, as a faster cooling rate is preferable to inhibit pearlitic transformation. However, from the viewpoint of cooling capacity of the facility, the second average cooling rate is preferably 100° C./s or less, for example.

Cooling Stop Temperature: 400° C. or More and 550° C. or Less

In order to inhibit pearlitic transformation during cooling and to secure an appropriate amount of bainite and retained austenite, the cooling stop temperature is 400° C. or more and 550° C. or less. Pearlitic transformation is promoted at cooling stop temperatures exceeding 550° C. The cooling stop temperature is therefore 550° C. or less. The cooling stop temperature is preferably 520° C. or less. The cooling stop temperature is more preferably 510° C. or less. On the other hand, when the cooling stop temperature is less than 400° C., excessive carbides formation occurs during bainitic transformation, and the desired amount of retained austenite and C concentration in the retained austenite are not obtainable. The cooling stop temperature is therefore 400° C. or more. The cooling stop temperature is preferably 450° C. or more. The cooling stop temperature is more preferably 460° C. or more.

[Holding Process]

The cold-rolled steel sheet cooled as described above is then held in a temperature range from 400° C. or more to 550° C. or less for 15 s or more and 90 s or less.

Hold Temperature Range: 400° C. or More and 550° C. or Less

From the viewpoint of securing an appropriate amount of bainite and retained austenite, the hold temperature range is 400° C. or more and 550° C. or less. When the hold temperature range is less than 400° C., the amount of carbides formed in bainitic transformation increases, and C concentration into austenite is inhibited. Therefore, the desired average solute C concentration of retained austenite and standard deviation of C concentration distribution are not obtainable. On the other hand, when the hold temperature range exceeds 550° C., bainitic transformation is delayed and an appropriate amount of bainite is not obtainable. Accordingly, the hold temperature range is 400° C. or more and 550° C. or less. The hold temperature range is preferably 450° C. or more. The hold temperature range is preferably 500° C. or less.

Hold Time: 15 s or More and 90 s or Less

To secure an appropriate amount of bainite, the hold time in the hold temperature range (hereinafter also referred to simply as hold time) needs to be appropriately controlled. The longer the hold time, the more bainitic transformation progresses and the more bainite is obtained. The hold time is therefore 15 s or more. The hold time is preferably 20 s or more. On the other hand, when the hold time is excessively long, the amount of bainite becomes excessive and martensite necessary to secure strength is not obtainable. The hold time is therefore 90 s or less. The hold time is preferably 80 s or less. The hold time here does not include the time in the temperature range of 400° C. or more and 550° C. or less in the cooling process (before cooling stop).

Further, after the holding process, the cold-rolled steel sheet may be further treated with a surface treatment such as chemical conversion treatment or organic coating treatment.

[Coating Process]

The cold-rolled steel sheet may then be subjected to a hot-dip galvanizing treatment. Treatment conditions may be in accordance with a conventional method. For example, after the cold-rolled steel sheet is immersed in a hot-dip galvanizing bath at 440° C. or more and 500° C. or less, the coating weight is preferably adjusted by gas wiping or the like. As a hot-dip galvanizing bath, there is no particular limitation as long as the composition of the hot-dip galvanized layer is as described above. For example, use of a coating bath including an Al content of 0.10 mass % or more and 0.23 mass % or less, with the balance being Zn and inevitable impurities, is preferable. Further, when coating process, reheating treatment immediately before the coating process is preferable, so that the sheet temperature entering the coating bath is higher than the coating bath temperature.

Further, the coating weight of a hot-dip galvanized steel sheet (GI) is preferably 20 g/m$^2$ to 80 g/m$^2$ per side. The coating weight may be adjusted by gas wiping and the like.

The steel sheet obtained as described above may be further subjected to temper rolling. When the rolling reduction of the temper rolling exceeds 2.00%, yield stress may increase and dimensional accuracy may decrease when forming the steel sheet into a member. Therefore, the rolling reduction of the temper rolling is preferably 2.00% or less. A lower limit of the rolling reduction of the temper rolling is not particularly limited. From the viewpoint of productivity, the rolling reduction of the temper rolling is preferably 0.05% or more. The temper rolling may be performed on equipment that is continuous (on-line) with the annealing equipment used to perform each of the aforementioned processes, and may be performed on equipment that is discontinuous (off-line) with the annealing equipment used to perform each of the processes. The number of rolling cycles for the temper rolling may be one, two, or more. Processing by a leveler or the like is also acceptable, as long as an equivalent elongation rate to temper rolling is provided.

From the viewpoint of productivity, performing the above series of processing, including the annealing process and the coating process, in a continuous annealing line (CAL) or a continuous hot-dip galvanizing line (CGL) is preferable. After the hot-dip galvanizing, wiping may be performed for adjusting the coating amount.

Conditions other than those described above are not particularly limited, and a conventional method may be used. According to the method of producing a steel sheet according to an embodiment of the present disclosure described above, a steel sheet having high strength, excellent ductility, high YR, and excellent bendability is obtainable, and the steel sheet may be appropriately used for an automobile member.

[4] Method of Producing Member

The following describes a method of producing a member according to an embodiment of the present disclosure.

The method of producing a member according to an embodiment of the present disclosure includes process of at least one of forming or joining the steel sheet described above to make the member.

Here, a forming method is not particularly limited, and a typical processing method such as press working may be used, for example. Further, a joining method is also not particularly limited, and for example, typical welding such as spot welding, laser welding, arc welding, and the like, rivet joining, swaging joining, and the like may be used. Forming and joining conditions are not particularly limited and may follow a conventional method.

EXAMPLES

Steel material having the chemical compositions listed in Table 1 (the balance being Fe and inevitable impurities) was melted in a converter and made into steel slabs by a continuous casting method. The obtained steel slabs were heated to 1200° C. After heating, the steel slabs were hot rolled, consisting of rough rolling and finish rolling, under the conditions listed in Table 2, to produce hot-rolled steel sheets each having a thickness of 3.2 mm. The hot-rolled steel sheets were then pickled and cold rolled to produce cold-rolled steel sheets each having a thickness of 1.4 mm. The obtained cold-rolled steel sheets were then subjected to the heating process, the annealing process, and the cooling process, and some to the coating process, under the conditions listed in Table 2, to obtain steel sheets as the final product.

In the coating process, hot-dip galvanizing treatment was performed to obtain hot-dip galvanized steel sheets (hereinafter also referred to as GI). In Table 2, the type of coating process is also indicated as "GI".

Further, as the galvanizing bath, the bath temperature was set at 470° C. for each case of producing GI. The coating weight was 45 g/m$^2$ to 72 g/m$^2$ per side. The composition of the hot-dip galvanized layer of the final GI contained Fe: 0.1 mass % to 1.0 mass % and Al: 0.20 mass % to 0.33 mass %, with the balance being Zn and inevitable impurities. Hot-dip galvanized layers were formed on both sides of the steel sheet.

The obtained steel sheets were used to identify the steel microstructure of the steel sheets, and the Mn concentration of retained austenite $[Mn]_\gamma$, the average solute C concentration $[C]_\gamma$, the standard deviation of C concentration distribution, and the thickness of the soft layer were measured as described above. The measurement results are listed in Table 3. In the steel sheets including a soft layer, the soft layer was formed on both sides of the steel sheet, and both sides were the same thickness. Further, in No. 36, no soft layer was observed (the thickness of the soft layer was less than 1 μm), so the column for the thickness of the soft layer in Table 3 is marked "-".

Further, tensile strength (TS), total elongation (E1), uniform elongation (U.E1), yield stress (YS), and R (limit bending radius)/t (sheet thickness of steel sheet) were evaluated according to the following criteria by conducting tensile test and V-bend tests according to the following procedures.

TS
Pass: 780 MPa≤TS
Fail: TS<780 MPa
E1
Pass: 19%≤E1
Fail: E1<19%
U.E1
Pass: 10%≤U.E1
Fail: U.E1<10%
YR
Pass: 0.48≤YR
Fail: YR<0.48
R/t
Pass: 2.0≥R/t
Fail: R/t>2.0

Tensile testing was performed in accordance with JIS Z 2241. That is, a JIS No. 5 test piece was taken from the obtained steel sheet such that the longitudinal direction was perpendicular to the rolling direction of the steel sheet. The collected test piece was subjected to tensile testing at a crosshead velocity of 10 mm/min to measure TS, YS, E1, and U.E1. Further, YR was calculated from TS and YS. The results are listed in Table 3.

A V (90°) bend test was performed in accordance with JIS Z 2248. That is, a 100 mm×35 mm test piece was taken from the steel sheet by shearing and edge grinding. Here, the 100 mm side was taken to be parallel to the transverse (C) direction. The test piece was then subjected to a V (90°) bend tests under the following conditions.

Bend radius R: changed at 0.5 mm pitch
Test method: die supported, punch pressed
Mold load: 10 t
Test speed: 30 mm/min
Hold time: 5 s
Bend direction: transverse (C) direction Three tests were conducted, and the minimum bend radius at which no cracking occurred in any of the three tests was defined as R. R/t was then calculated by dividing R by the sheet thickness t. The test piece was observed using a Leica stereo microscope at a magnification of 25×, and cracks having a length of 200 μm or more were considered to be cracks. The results are listed in Table 3.

TABLE 1

| Steel | Chemical composition (mass %) | | | | | | | | |
|---|---|---|---|---|---|---|---|---|---|
| ID | C | Si | Mn | P | S | sol. Al | N | Other | Remarks |
| A | 0.10 | 0.4 | 1.9 | 0.006 | 0.0009 | 0.026 | 0.0029 | — | Conforming steel |
| B | 0.19 | 0.8 | 1.7 | 0.006 | 0.0010 | 0.044 | 0.0028 | — | Conforming steel |
| C | 0.13 | 0.4 | 2.2 | 0.005 | 0.0004 | 0.025 | 0.0050 | — | Conforming steel |
| D | 0.14 | 1.4 | 2.5 | 0.006 | 0.0014 | 0.038 | 0.0033 | — | Conforming steel |
| E | 0.15 | 0.7 | 1.6 | 0.007 | 0.0008 | 0.037 | 0.0045 | — | Conforming steel |
| F | 0.13 | 1.0 | 2.9 | 0.005 | 0.0019 | 0.021 | 0.0046 | — | Conforming steel |
| G | 0.11 | 0.9 | 2.1 | 0.080 | 0.0005 | 0.500 | 0.0041 | — | Conforming steel |
| H | 0.13 | 0.9 | 1.9 | 0.006 | 0.0006 | 0.041 | 0.0037 | — | Conforming steel |
| I | 0.17 | 0.6 | 2.0 | 0.004 | 0.0008 | 0.038 | 0.0044 | — | Conforming steel |
| J | 0.11 | 1.2 | 2.6 | 0.006 | 0.0011 | 0.039 | 0.0038 | — | Conforming steel |
| K | 0.18 | 0.8 | 2.6 | 0.007 | 0.0009 | 0.044 | 0.0021 | — | Conforming steel |
| L | 0.19 | 0.4 | 1.6 | 0.008 | 0.0008 | 0.036 | 0.0029 | B: 0.001, V: 0.003, Cu: 0.2 | Conforming steel |
| M | 0.14 | 0.9 | 2.4 | 0.003 | 0.0009 | 0.041 | 0.0037 | Ti: 0.03, Cr: 0.1 | Conforming steel |
| N | 0.20 | 1.5 | 1.5 | 0.006 | 0.0010 | 0.040 | 0.0035 | Cr: 0.04, V: 0.005, Zr: 0.004 | Conforming steel |
| O | 0.17 | 0.7 | 1.9 | 0.005 | 0.0011 | 0.029 | 0.0046 | Nb: 0.02, V: 0.005, W: 0.008 | Conforming steel |
| P | 0.19 | 1.1 | 2.1 | 0.006 | 0.0008 | 0.026 | 0.0040 | Ni: 0.02, Sb: 0.008, B: 0.002 | Conforming steel |
| Q | 0.11 | 0.5 | 2.1 | 0.007 | 0.0006 | 0.031 | 0.0030 | Sb0.010, Sn: 0.005, Ti: 0.01 | Conforming steel |
| R | 0.12 | 0.7 | 2.4 | 0.006 | 0.0007 | 0.031 | 0.0023 | Ca: 0.0030, Mg: 0.0008 | Conforming steel |
| S | 0.14 | 1.4 | 2.2 | 0.005 | 0.0005 | 0.035 | 0.0043 | Mg: 0.0005, REM: 0.0003 | Conforming steel |
| T | 0.16 | 0.7 | 2.8 | 0.004 | 0.0005 | 0.032 | 0.0039 | Mo: 0.02, Cr: 0.03, Sb: 0.01 | Conforming steel |
| U | 0.07 | 1.5 | 2.6 | 0.008 | 0.0010 | 0.032 | 0.0039 | — | Comparative steel |
| V | 0.22 | 0.7 | 2.3 | 0.008 | 0.0010 | 0.017 | 0.0052 | — | Comparative steel |
| W | 0.18 | 0.1 | 1.9 | 0.009 | 0.0011 | 0.038 | 0.0033 | — | Comparative steel |
| X | 0.13 | 0.9 | 1.3 | 0.009 | 0.0006 | 0.041 | 0.0037 | — | Comparative steel |
| Y | 0.11 | 0.4 | 3.1 | 0.010 | 0.0008 | 0.038 | 0.0034 | — | Comparative steel |

TABLE 2

| | | Hot rolling process | | | | Annealing process | | | Cooling process | | | | |
|---|---|---|---|---|---|---|---|---|---|---|---|---|---|
| No. | Steel ID | Rolling finish temp. (° C.) | First average cooling rate (° C./s) | Coiling temp. (° C.) | Heating process X | Annealing temp. (° C.) | Annealing time (s) | Dew point (° C.) | Second average cooling rate (° C./s) | Cooling stop temp. (° C.) | Holding process Hold time (s) | Coating process Type | Remarks |
| 1 | A | 880 | 30 | 570 | 3641 | 840 | 9 | −10 | 30 | 510 | 27 | GI | Example |
| 2 | B | 880 | 30 | 590 | 2266 | 780 | 9 | −10 | 26 | 500 | 27 | GI | Example |
| 3 | C | 880 | 30 | 560 | 3608 | 850 | 6 | −15 | 45 | 490 | 20 | GI | Example |
| 4 | D | 880 | 30 | 550 | 4270 | 860 | 9 | −15 | 35 | 480 | 27 | GI | Example |
| 5 | E | 880 | 30 | 550 | 2811 | 830 | 6 | −10 | 50 | 480 | 18 | GI | Example |
| 6 | F | 880 | 30 | 560 | 3907 | 860 | 5 | −15 | 56 | 490 | 17 | GI | Example |
| 7 | G | 850 | 30 | 540 | 4487 | 870 | 7 | −15 | 43 | 500 | 21 | GI | Example |
| 8 | H | 880 | 20 | 580 | 4624 | 870 | 9 | −10 | 37 | 470 | 27 | GI | Example |
| 9 | I | 880 | 30 | 610 | 3960 | 870 | 6 | −10 | 53 | 470 | 19 | GI | Example |
| 10 | J | 880 | 30 | 560 | 4624 | 870 | 9 | −10 | 37 | 470 | 27 | GI | Example |
| 11 | K | 880 | 30 | 570 | 3102 | 820 | 7 | −5 | 34 | 510 | 23 | — | Example |
| 12 | L | 880 | 30 | 580 | 4657 | 870 | 8 | −10 | 40 | 470 | 25 | GI | Example |
| 13 | M | 850 | 30 | 520 | 2324 | 780 | 11 | −5 | 21 | 500 | 33 | GI | Example |
| 14 | N | 880 | 30 | 610 | 2061 | 780 | 5 | −10 | 39 | 520 | 17 | GI | Example |
| 15 | O | 880 | 30 | 540 | 2653 | 800 | 9 | −5 | 28 | 500 | 27 | GI | Example |
| 16 | P | 880 | 20 | 560 | 2864 | 810 | 7 | −10 | 37 | 470 | 23 | — | Example |
| 17 | Q | 880 | 30 | 530 | 4631 | 870 | 7 | −20 | 15 | 480 | 23 | GI | Example |
| 18 | R | 880 | 30 | 570 | 2427 | 800 | 6 | −10 | 38 | 500 | 20 | GI | Example |
| 19 | S | 880 | 30 | 590 | 4141 | 860 | 7 | −10 | 47 | 460 | 21 | GI | Example |
| 20 | T | 850 | 30 | 520 | 2827 | 790 | 14 | −15 | 16 | 520 | 43 | GI | Example |
| 21 | U | 880 | 30 | 580 | 4242 | 850 | 12 | −15 | 22 | 520 | 38 | GI | Comparative Example |
| 22 | V | 880 | 30 | 560 | 2843 | 820 | 6 | −10 | 45 | 460 | 20 | — | Comparative Example |
| 23 | W | 880 | 30 | 550 | 3191 | 800 | 19 | −15 | 13 | 480 | 60 | GI | Comparative Example |
| 24 | X | 850 | 30 | 520 | 2333 | 760 | 19 | −15 | 30 | 520 | 60 | GI | Comparative Example |
| 25 | Y | 880 | 30 | 550 | 3642 | 840 | 10 | −10 | 29 | 490 | 30 | GI | Comparative Example |
| 26 | H | 820 | 30 | 590 | 2443 | 790 | 7 | −15 | 31 | 500 | 23 | GI | Comparative Example |
| 27 | H | 880 | 6 | 610 | 3919 | 840 | 12 | −10 | 23 | 490 | 38 | GI | Comparative Example |
| 28 | H | 880 | 20 | 680 | 2231 | 790 | 5 | −15 | 41 | 520 | 17 | GI | Comparative Example |
| 29 | H | 880 | 30 | 590 | 880 | 800 | 7 | −10 | 33 | 500 | 23 | GI | Comparative Example |
| 30 | I | 880 | 30 | 540 | 8900 | 810 | 14 | −15 | 19 | 480 | 43 | GI | Comparative Example |
| 31 | I | 880 | 30 | 550 | 7000 | 800 | 5 | −15 | 51 | 460 | 17 | GI | Example |
| 32 | I | 880 | 30 | 590 | 1653 | 730 | 12 | −10 | 17 | 480 | 38 | GI | Comparative Example |
| 33 | I | 880 | 30 | 590 | 6388 | 930 | 6 | −15 | 57 | 500 | 19 | GI | Comparative Example |
| 34 | J | 880 | 30 | 550 | 3724 | 840 | 0.4 | −10 | 27 | 480 | 33 | GI | Comparative Example |
| 35 | J | 880 | 30 | 580 | 2565 | 800 | 40 | −15 | 40 | 460 | 21 | GI | Comparative Example |
| 36 | J | 880 | 30 | 550 | 3882 | 830 | 14 | −50 | 20 | 490 | 43 | GI | Example |
| 37 | J | 880 | 30 | 550 | 4242 | 850 | 12 | −10 | 6 | 490 | 38 | GI | Comparative Example |
| 38 | K | 880 | 30 | 550 | 3123 | 840 | 6 | −10 | 36 | 570 | 19 | GI | Comparative Example |
| 39 | K | 880 | 30 | 550 | 2452 | 790 | 9 | −10 | 38 | 380 | 27 | GI | Comparative Example |
| 40 | K | 880 | 30 | 550 | 3640 | 840 | 7 | −10 | 47 | 410 | 23 | GI | Example |
| 41 | K | 880 | 30 | 550 | 2461 | 790 | 8 | −10 | 30 | 490 | 10 | GI | Comparative Example |
| 42 | K | 880 | 30 | 550 | 3724 | 840 | 11 | −10 | 26 | 490 | 110 | GI | Comparative Example |
| 43 | K | 880 | 30 | 550 | 2617 | 810 | 5 | −10 | 48 | 490 | 17 | GI | Example |

TABLE 3

| | | Steel microstructure | | | | | | |
|---|---|---|---|---|---|---|---|---|
| | | Area ratio (%) | | | | | | Standard deviation of C concentration distribution |
| No. | Steel ID | Ferrite | Martensite | Bainite | Retained austenite (γ) | $[Mn]_\gamma/[Mn]$ | $[C]_\gamma$ (mass %) | of retained austenite (γ) (mass %) |
| 1 | A | 20 | 36 | 31 | 10 | 1.11 | 0.9 | 0.235 |
| 2 | B | 34 | 27 | 22 | 8 | 1.12 | 0.8 | 0.239 |
| 3 | C | 15 | 45 | 28 | 9 | 1.09 | 0.8 | 0.235 |
| 4 | D | 20 | 45 | 23 | 11 | 1.10 | 0.9 | 0.233 |
| 5 | E | 12 | 28 | 38 | 13 | 1.07 | 1.1 | 0.226 |
| 6 | F | 13 | 33 | 39 | 14 | 1.09 | 1.2 | 0.226 |
| 7 | G | 39 | 35 | 18 | 7 | 1.08 | 0.7 | 0.237 |
| 8 | H | 20 | 33 | 29 | 11 | 1.13 | 1.0 | 0.236 |
| 9 | I | 14 | 45 | 29 | 9 | 1.15 | 0.8 | 0.240 |
| 10 | J | 20 | 39 | 23 | 10 | 1.11 | 0.9 | 0.236 |
| 11 | K | 17 | 49 | 24 | 9 | 1.10 | 0.8 | 0.236 |
| 12 | L | 19 | 41 | 31 | 10 | 1.13 | 0.9 | 0.238 |
| 13 | M | 47 | 30 | 12 | 6 | 1.05 | 0.5 | 0.237 |
| 14 | N | 29 | 31 | 21 | 10 | 1.13 | 0.9 | 0.237 |
| 15 | O | 22 | 34 | 31 | 11 | 1.07 | 1.0 | 0.229 |
| 16 | P | 16 | 40 | 32 | 12 | 1.09 | 1.1 | 0.230 |
| 17 | Q | 17 | 42 | 28 | 9 | 1.07 | 0.8 | 0.233 |
| 18 | R | 32 | 46 | 12 | 5 | 1.09 | 0.6 | 0.241 |
| 19 | S | 16 | 44 | 27 | 11 | 1.13 | 1.0 | 0.235 |
| 20 | T | 40 | 32 | 14 | 7 | 1.07 | 0.6 | 0.237 |
| 21 | U | 28 | 36 | 23 | 12 | 1.14 | 1.0 | 0.236 |
| 22 | V | 15 | 47 | 28 | 9 | 1.08 | 0.8 | 0.234 |
| 23 | W | 34 | 18 | 42 | 4 | 1.12 | 0.4 | 0.247 |
| 24 | X | 66 | 5 | 18 | 6 | 1.08 | 0.5 | 0.240 |
| 25 | Y | 10 | 68 | 11 | 7 | 1.17 | 0.6 | 0.247 |
| 26 | H | 33 | 57 | 8 | 2 | 1.27 | 0.2 | 0.267 |
| 27 | H | 30 | 54 | 9 | 3 | 1.26 | 0.3 | 0.263 |
| 28 | H | 30 | 53 | 9 | 4 | 1.21 | 0.4 | 0.257 |
| 29 | H | 16 | 38 | 36 | 6 | 1.05 | 0.4 | 0.238 |
| 30 | I | 11 | 77 | 8 | 4 | 1.30 | 0.4 | 0.266 |
| 31 | I | 22 | 55 | 15 | 5 | 1.06 | 0.5 | 0.239 |
| 32 | I | 70 | 12 | 11 | 4 | 1.12 | 0.4 | 0.248 |
| 33 | I | 3 | 45 | 42 | 10 | 1.15 | 0.9 | 0.240 |
| 34 | J | 25 | 37 | 29 | 4 | 1.06 | 0.4 | 0.242 |
| 35 | J | 28 | 59 | 7 | 3 | 1.23 | 0.3 | 0.261 |
| 36 | J | 14 | 28 | 44 | 11 | 1.11 | 1.0 | 0.234 |
| 37 | J | 50 | 9 | 19 | 4 | 1.11 | 0.4 | 0.247 |
| 38 | K | 14 | 73 | 7 | 2 | 1.07 | 0.2 | 0.247 |
| 39 | K | 18 | 37 | 33 | 6 | 1.08 | 0.4 | 0.241 |
| 40 | K | 17 | 49 | 25 | 7 | 1.08 | 0.6 | 0.238 |
| 41 | K | 30 | 62 | 6 | 0 | 1.07 | — | — |
| 42 | K | 9 | 8 | 66 | 14 | 1.10 | 1.3 | 0.226 |
| 43 | K | 37 | 40 | 15 | 6 | 1.07 | 0.5 | 0.239 |

| | Steel microstructure Soft phase | Properties | | | | | | |
|---|---|---|---|---|---|---|---|---|
| No. | thickness (μm) | TS (MPa) | YS (MPa) | YR | El (%) | U.El (%) | R/t | Remarks |
| 1 | 4 | 885 | 562 | 0.64 | 24 | 14 | 1.4 | Example |
| 2 | 22 | 820 | 515 | 0.63 | 26 | 14 | 1.4 | Example |
| 3 | 3 | 919 | 561 | 0.61 | 20 | 11 | 1.4 | Example |
| 4 | 10 | 916 | 658 | 0.72 | 25 | 15 | 1.4 | Example |
| 5 | 18 | 898 | 650 | 0.72 | 25 | 16 | 1.1 | Example |
| 6 | 19 | 929 | 703 | 0.76 | 27 | 19 | 1.4 | Example |
| 7 | 20 | 820 | 498 | 0.61 | 27 | 13 | 1.4 | Example |
| 8 | 18 | 879 | 610 | 0.69 | 25 | 15 | 1.4 | Example |
| 9 | 27 | 926 | 593 | 0.64 | 20 | 12 | 1.1 | Example |
| 10 | 7 | 889 | 615 | 0.69 | 24 | 14 | 1.4 | Example |
| 11 | 38 | 932 | 593 | 0.64 | 21 | 12 | 0.4 | Example |
| 12 | 5 | 905 | 567 | 0.63 | 22 | 13 | 1.4 | Example |
| 13 | 41 | 781 | 440 | 0.56 | 27 | 12 | 0.7 | Example |
| 14 | 23 | 847 | 620 | 0.73 | 27 | 16 | 1.4 | Example |
| 15 | 22 | 883 | 595 | 0.67 | 26 | 16 | 1.4 | Example |
| 16 | 22 | 925 | 673 | 0.73 | 25 | 16 | 1.4 | Example |
| 17 | 11 | 904 | 563 | 0.62 | 21 | 12 | 1.4 | Example |
| 18 | 8 | 853 | 460 | 0.54 | 20 | 13 | 1.4 | Example |

TABLE 3-continued

| | | | | | | | | |
|---|---|---|---|---|---|---|---|---|
| 19 | 22 | 926 | 688 | 0.74 | 25 | 16 | 1.4 | Example |
| 20 | 10 | 815 | 455 | 0.56 | 25 | 12 | 1.4 | Example |
| 21 | 15 | 680 | 390 | 0.57 | 30 | 18 | 1.4 | Comparative Example |
| 22 | 17 | 939 | 606 | 0.65 | 20 | 12 | 2.1 | Comparative Example |
| 23 | 13 | 805 | 404 | 0.50 | 16 | 5 | 1.4 | Comparative Example |
| 24 | 12 | 665 | 383 | 0.58 | 34 | 16 | 1.4 | Comparative Example |
| 25 | 15 | 972 | 410 | 0.42 | 16 | 7 | 2.1 | Comparative Example |
| 26 | 12 | 869 | 401 | 0.46 | 16 | 8 | 1.1 | Comparative Example |
| 27 | 16 | 869 | 399 | 0.46 | 17 | 7 | 1.4 | Comparative Example |
| 28 | 21 | 868 | 409 | 0.47 | 18 | 9 | 1.4 | Comparative Example |
| 29 | 17 | 898 | 592 | 0.66 | 16 | 7 | 1.4 | Comparative Example |
| 30 | 24 | 960 | 530 | 0.55 | 11 | 7 | 2.9 | Comparative Example |
| 31 | 7 | 907 | 502 | 0.55 | 19 | 11 | 1.4 | Example |
| 32 | 17 | 666 | 309 | 0.46 | 32 | 13 | 1.4 | Comparative Example |
| 33 | 27 | 970 | 665 | 0.69 | 17 | 11 | 2.1 | Comparative Example |
| 34 | 25 | 863 | 497 | 0.58 | 16 | 5 | 1.4 | Comparative Example |
| 35 | 9 | 893 | 422 | 0.47 | 16 | 9 | 1.4 | Comparative Example |
| 36 | — | 904 | 554 | 0.61 | 23 | 15 | 1.8 | Example |
| 37 | 12 | 718 | 402 | 0.56 | 26 | 10 | 1.4 | Comparative Example |
| 38 | 9 | 958 | 435 | 0.45 | 20 | 8 | 2.5 | Comparative Example |
| 39 | 17 | 897 | 568 | 0.63 | 17 | 7 | 1.4 | Comparative Example |
| 40 | 23 | 926 | 445 | 0.48 | 19 | 11 | 1.4 | Example |
| 41 | 30 | 977 | 460 | 0.47 | 14 | 8 | 2.5 | Comparative Example |
| 42 | 29 | 755 | 555 | 0.74 | 25 | 15 | 1.4 | Comparative Example |
| 43 | 4 | 843 | 477 | 0.57 | 20 | 10 | 1.4 | Example |

As indicated in Table 3, tensile strength (TS), total elongation (E1), uniform elongation (U.E1), yield stress (YS), and R (limit bending radius)/t (sheet thickness of steel sheet) were all acceptable in each of the Examples. Further, tensile strength (TS), total elongation (E1), uniform elongation (U.E1), yield stress (YS), and R (limit bending radius)/t (sheet thickness of steel sheet) were all excellent for each of the members obtained by forming or joining using the steel sheets of the Examples.

In contrast, at least one of tensile strength (TS), total elongation (E1), uniform elongation (U.E1), yield stress (YS), or R (limit bending radius)/t (sheet thickness of steel sheet) was not sufficient in the Comparative Examples.

The invention claimed is:

1. A steel sheet comprising: a chemical composition containing, in mass %,

C: 0.09% or more and 0.20% or less,

Si: 0.3% or more and 1.5% or less,

Mn: 1.5% or more and 3.0% or less,

P: 0.001% or more and 0.100% or less,

S: 0.050% or less,

Al: 0.005% or more and 1.000% or less, and

N: 0.010% or less, with the balance being Fe and inevitable impurities; the steel microstructure comprising:

area ratio of ferrite: 5% or more and 65% or less, area ratio of martensite: 10% or more and 60% or less, area ratio of bainite: 10% or more and 60% or less, and area ratio of retained austenite: 5% or more, wherein Formula (1) is satisfied, average solute C concentration of the retained austenite $[C]_\gamma$ is 0.5 mass % or more, and standard deviation of C concentration distribution in the retained austenite is 0.250 mass % or less, and the steel sheet has a tensile strength of 780 MPa or more, $$[Mn]_\gamma/[Mn] \leq 1.20 \quad (1)$$

wherein $[Mn]_\gamma$ is Mn concentration, in mass %, in retained austenite, and

[Mn] is Mn content, in mass %, in the chemical composition of the steel sheet.

2. The steel sheet according to claim 1, wherein the chemical composition further contains, in mass %, at least one selected from the group consisting of:

Ti: 0.2% or less,

Nb: 0.2% or less,

B: 0.0050% or less,

Cu: 1.0% or less,

Ni: 0.5% or less,

Cr: 1.0% or less,

Mo: 0.3% or less,
V: 0.45% or less,
Zr: 0.2% or less,
W: 0.2% or less,
Sb: 0.1% or less,
Sn: 0.1% or less,
Ca: 0.0050% or less,
Mg: 0.01% or less, and
REM: 0.01% or less.

3. The steel sheet according to claim 1, further comprising at least one of a soft layer having a thickness of 1 μm or more and 50 μm or less and a hot-dip galvanized layer on a surface, wherein the soft layer is a region where hardness is 65% or less of hardness at a ¼ sheet thickness position of the steel sheet.

4. A member made using the steel sheet according to claim 1.

5. A method of producing the steel sheet according to claim 1, the method comprising:

a hot rolling process of hot rolling a steel slab having the chemical composition according to claim 1 to obtain a hot-rolled steel sheet, under a set of conditions including:

rolling finish temperature: 840° C. or more, average cooling rate in a temperature range from the rolling finish temperature to 700° C.: 10° C./s or more, and coiling temperature: 620° C. or less;

a cold rolling process of cold rolling the hot-rolled steel sheet to obtain a cold-rolled steel sheet;

a heating process of heating the cold-rolled steel sheet under a set of conditions satisfying Formula (2) in a temperature range from 600° C. to 750° C.;

an annealing process of annealing the cold-rolled steel sheet, under a set of conditions including:

annealing temperature: 750° C. or more and 920° C. or less, and annealing time: 1 s or more and 30 s or less;

a cooling process of cooling the cold-rolled steel sheet, under a set of conditions including:

average cooling rate in a temperature range from the annealing temperature to 550° C.: 10° C./s or more, and cooling stop temperature: 400° C. or more and 550° C. or less; and a holding process of holding the cold-rolled steel sheet in a temperature range of 400° C. or more and 550° C. or less for 15 s or more and 90 s or less, $$1000 \leq X \leq 7500 \quad (2)$$

where X is defined by formula:

$$X = \log A \times \sum_{i=1}^{10} 1.05^{(T_i - 600)} \quad \text{[Math. 1]}$$

where

A is time in seconds that the cold-rolled steel sheet is held in the temperature range from 600° C. to 750° C. during the heating process, $T_i$ is average temperature in ° C. of the cold-rolled steel sheet during an i-th time period in a time sequence of time periods dividing A into 10 equal parts, and i is an integer from 1 to 10.

6. The method according to claim 5, wherein the dew point of the atmosphere in the heating process and the annealing process is −35° C. or more.

7. The method according to claim 5, further comprising a coating process after the holding process, in which hot-dip galvanizing treatment is performed.

8. A method of producing the member according to claim 4, wherein the steel sheet is subjected to at least one of a forming process and a joining process to produce the member.

9. The steel sheet according to claim 2, further comprising at least one of a soft layer having a thickness of 1 μm or more and 50 μm or less and a hot-dip galvanized layer on a surface, wherein the soft layer is a region where hardness is 65% or less of hardness at a ¼ sheet thickness position of the steel sheet.

10. A member made using the steel sheet according to claim 2.

11. A member made using the steel sheet according to claim 3.

12. A member made using the steel sheet according to claim 9.

13. The method according to claim 6, further comprising a coating process after the holding process, in which hot-dip galvanizing treatment is performed.

14. A method of producing the steel sheet according to claim 2, the method comprising:

a hot rolling process of hot rolling a steel slab having the chemical composition according to claim 2 to obtain a hot-rolled steel sheet, under a set of conditions including:

rolling finish temperature: 840° C. or more, average cooling rate in a temperature range from the rolling finish temperature to 700° C.: 10° C./s or more, and coiling temperature: 620° C. or less;

a cold rolling process of cold rolling the hot-rolled steel sheet to obtain a cold-rolled steel sheet;

a heating process of heating the cold-rolled steel sheet under a set of conditions satisfying Formula (2) in a temperature range from 600° C. to 750° C.;

an annealing process of annealing the cold-rolled steel sheet, under a set of conditions including:

annealing temperature: 750° C. or more and 920° C. or less, and annealing time: 1 s or more and 30 s or less;

a cooling process of cooling the cold-rolled steel sheet, under a set of conditions including:

average cooling rate in a temperature range from the annealing temperature to 550° C.: 10° C./s or more, and cooling stop temperature: 400° C. or more and 550° C. or less; and a holding process of holding the cold-rolled steel sheet in a temperature range of 400° C. or more and 550° C. or less for 15 s or more and 90 s or less, $$1000 \leq X \leq 7500 \quad (2)$$

where X is defined by formula;

$$X = \log A \times \sum_{i=1}^{10} 1.05^{(T_i - 600)} \quad \text{[Math. 1]}$$

where

A is time in seconds that the cold-rolled steel sheet is held in the temperature range from 600° C. to 750° C. during the heating process, $T_i$ is average temperature in ° C. of the cold-rolled steel sheet during an i-th time period in a time sequence of time periods dividing A into 10 equal parts, and i is an integer from 1 to 10.

15. The method according to claim 14, wherein the dew point of the atmosphere in the heating process and the annealing process is −35° C. or more.

16. The method according to claim 14, further comprising a coating process after the holding process, in which hot-dip galvanizing treatment is performed.

17. The method according to claim 15, further comprising a coating process after the holding process, in which hot-dip galvanizing treatment is performed.

18. A method of producing the member according to claim 10, wherein the steel sheet is subjected to at least one of a forming process and a joining process to produce the member.

19. A method of producing the member according to claim 11, wherein the steel sheet is subjected to at least one of a forming process and a joining process to produce the member.

20. A method of producing the member according to claim 12, wherein the steel sheet is subjected to at least one of a forming process and a joining process to produce the member.

* * * * *